US006073835A

United States Patent [19]

Ramadan

[11] Patent Number: 6,073,835

[45] Date of Patent: Jun. 13, 2000

[54] MECHANICAL MODEL AND COUNTER METHOD AND APPARATUS

[76] Inventor: Imad Ramadan, P.O. Box 706, Totowa, N.J. 07511

[21] Appl. No.: 08/987,811

[22] Filed: Dec. 10, 1997

[51] Int. Cl.[7] ..... G06C 27/00

[52] U.S. Cl. ..... 235/78 G; 235/1 R; 235/1 B; 84/94.2; 446/8; 446/270

[58] Field of Search ..... 446/8, 270; 235/1 R, 235/1 B; 84/94.2

[56] References Cited

U.S. PATENT DOCUMENTS 3,478,464 11/1969 Appel ..... 446/9
4,718,667 1/1988 Shoemaker, Jr. ..... 273/1

*Primary Examiner*—Donald Hajec
*Assistant Examiner*—Jamara Franklin
*Attorney, Agent, or Firm*—Walter J. Tencza, Jr.

[57] ABSTRACT

A model, a counter, an actuator, and a termination device is provided. During a rest state the model is stationary in a first position and the counter is not counting. During a first transition state the model moves from its first position to a second position in response to actuation of the actuator and the counter begin counting. During an operation state the model is stationary in a second position and the counter is counting. During a second transition state, in response to a termination device the model moves from its second position back to its first position and the counter stops counting. A timing mechanism is provided for controlling the duration of the operation state. The counter can be any type, such as a dial counter, digital counter, or analog counter. The actuator may also activate a music box.

28 Claims, 16 Drawing Sheets

MECHANICAL MODEL AND COUNTER METHOD AND APPARATUS

FIELD OF THE INVENTION

This invention relates to the field of mechanical devices and more particularly, mechanical toys and counting devices which can be actuated to result in mechanical movements.

BACKGROUND OF THE INVENTION

Various apparatus and methods are known in the art for providing mechanical devices such as mechanical toys or animatronic toys.

SUMMARY OF THE INVENTION

The present invention in one embodiment is comprised of a model, a counter, an actuator, a termination device, a timing mechanism, and a model movement device. During a rest state the model is stationary in a first position and the counter is not counting. During a first transition state the model movement device moves the model from its first position to a second position in response to actuation by the actuator and the counter begins counting. During an operation state the model is stationary in a second position and the counter is counting. The duration of time of the operation state is preferably controlled by the timing mechanism. During a second transition state, in response to a termination device, which may be comprised of the timing mechanism, the model movement device moves the model from its second position back to its first position and the counter stops counting.

The counter can be any type, such as a dial counter, digital counter, or analog counter. The actuator may also activate a music box. In one embodiment the apparatus is a mechanical toy which looks like a gas pump with a model and the counter is actually comprised of a first counter and a second counter: one counter for dollars and cents and one counter for gallons and fractions of gallons of gas. The model preferably looks like an individual, and simulates gas pumping movements.

DETAILED DESCRIPTION OF THE DRAWINGS

Figure 1:
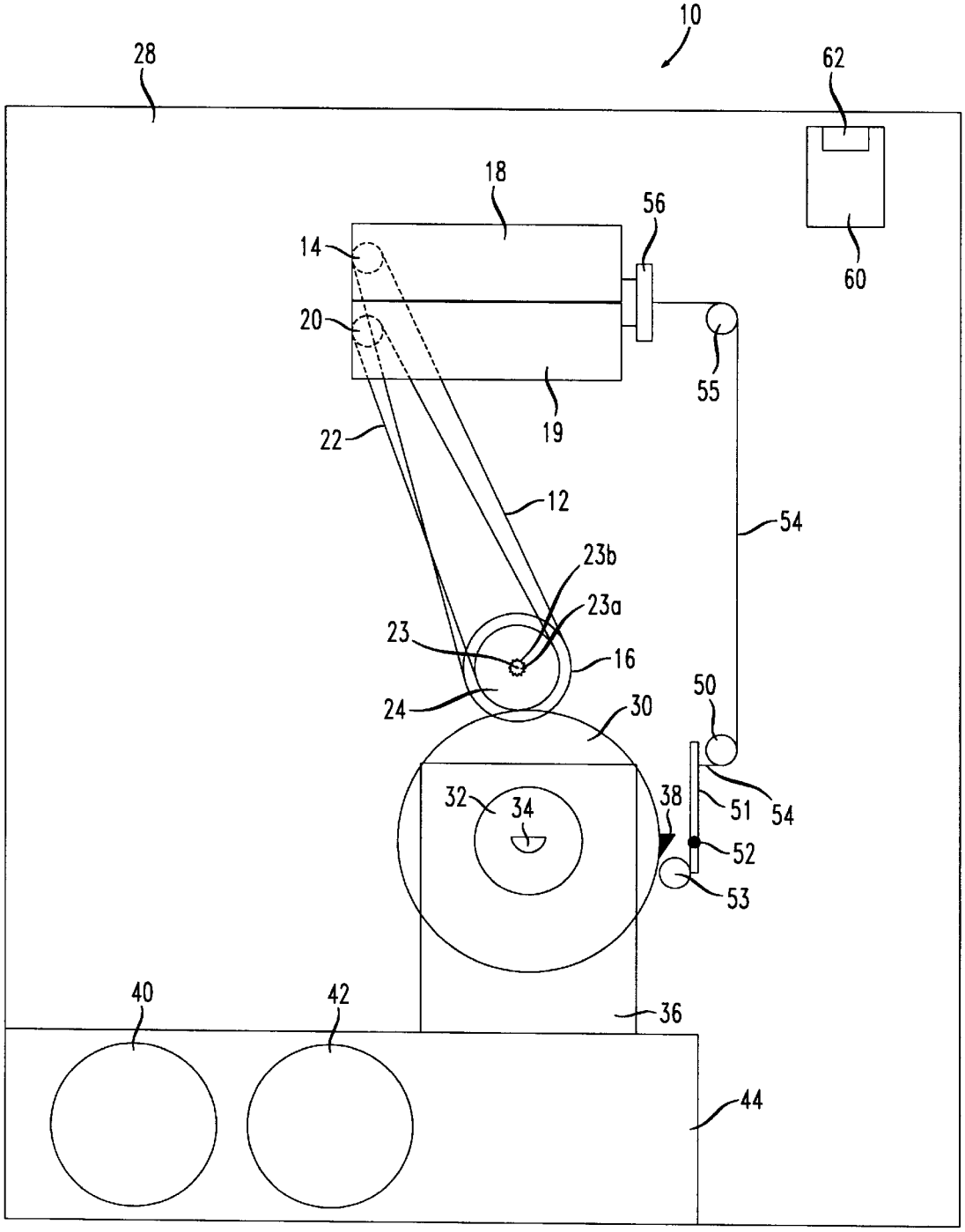
FIG. 1 shows a front view of a first layer of a first embodiment of the present invention.

FIGS. 1–4 show front views of various layers of the apparatus 10. The apparatus 10 includes reset wheel 30, shown in FIG. 1, counter gear 70, shown in FIG. 2, roller switch wheel 90, shown in FIG. 3, and model wheel 100, shown in FIG. 4. Generally speaking reset wheel 30 resets counters 18 and 19, counter wheel 70 increments the counters 18 and 19, roller switch wheel 90 sustains activation of a motor 32, and model wheel 100 controls movement of a model 140, shown in FIG. 4. The model wheel 100 can be thought of as being part of a model movement device. The roller switch wheel 90 can be thought of as being part of a termination device. Reset wheel 30, counter wheel 70, roller switch wheel 90, and model wheel 100 are preferably all controlled by a single control means which is comprised of the motor 32.

Figure 6:
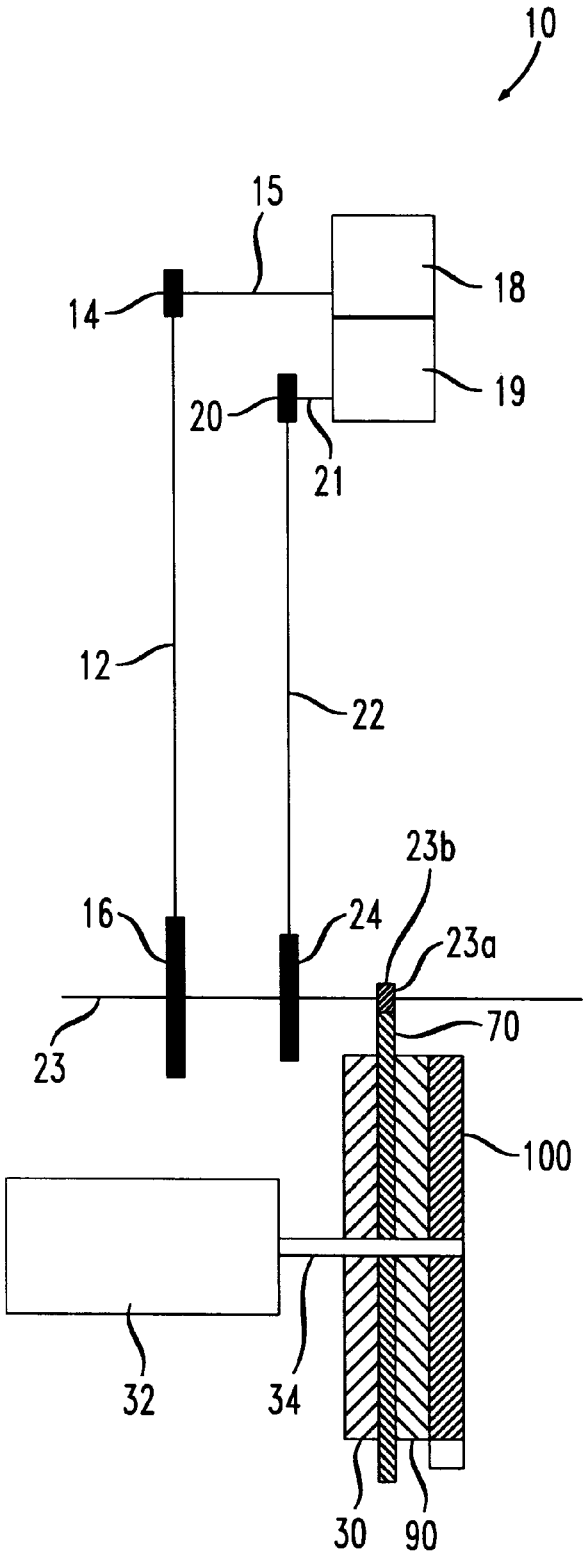
FIG. 6 shows a side view of some of the components of the first embodiment of the present invention.

Concerning the counter operation, apparatus 10, as shown in FIG. 1, includes belt 12 which at one end circles around small pulley 14 and at the other end circles around a large pulley 16. The apparatus 10 also includes a belt 22 which at one end circles a small pulley 20 and at another end circles around a large pulley 24. The large pulleys 16 and 24 are centered on a shaft 23 as shown in FIG. 6. The sizes of pulleys 16 and 24 determine the counting rates of the counters 18 and 19, respectively. Preferably pulley 16 is larger than pulley 24 to provide different counting rates.

The shaft 23 has a small gear 23*a* mounted thereon as shown in FIGS. 1 and 6. The shaft 23 is mounted in a manner which allows it to rotate. When the shaft 23 rotates the large pulleys 16 and 24 also rotate. The rotation of large pulley 16 causes the belt 12 to move, which causes the rotation of small pulley 14. The rotation of large pulley 24 causes the belt 22 to move, which causes the rotation of small pulley 20. Small pulley 14 is centrally mounted on an axle 15 as shown in FIG. 6. When the small pulley 14 rotates the axle 15 also rotates. The axle 15 is connected to a counter 18 as shown in FIG. 6. The counter 18 indicates an amount of money, preferably dollars and cents. Rotation of the small pulley 14 and the axle 15 causes the contents of the counter 18 to increase.

Small pulley 20 is centrally mounted on an axle 21 as shown in FIG. 6. When the small pulley 20 rotates the axle 21 also rotates. The axle 21 is connected to a counter 19 as shown in FIG. 6. The counter 19 preferably indicates gallons of gas and fractions of gallons of gas. Rotation of the small pulley 20 and the axle 21 causes the contents of the counter 19 to increase. The counters 18 and 19 can be mounted on a fixed housing 28, shown in FIG. 1. Belts 12 and 22 are preferably made of a flexible, expandable material, such as a rubber material.

The apparatus 10 also comprises a motor 32. The motor 32 includes an axle 34. When the motor 32 is turned on, the axle 34 rotates clockwise, as seen by looking at the view of FIG. 1. The motor 32 is mounted to a fixed stand 36. The axle 34 is connected to a reset wheel 30 as shown in FIGS. 1 and 6. When the axle 34 rotates, the reset wheel 30 rotates in the same direction. The axle 34 preferably rotates clockwise. The reset wheel 30 has a single protrusion 38 which may be triangular shaped. The stand 36 can be mounted to the housing 28.

Batteries 40 and 42, which may be Duracell (trademark), size D batteries, are shown in FIG. 1. The batteries 40 and 42 are in a casing 44. Apparatus 10, also includes lever 51, pivot point 52, and roller 53. The non-roller end of the lever 51 is connected to a string 54 as shown in FIG. 1. The string 54 winds around a pulley 50 and up and around another pulley 55 and is then connected to a reset mechanism 56. The reset mechanism 56 when pulled resets both counters 18 and 19. The reset mechanism 56 preferably shortly after being pulled springs back to its normal position in a known manner. The pulleys 50 and 55 are preferably rotatably mounted to housing 28.

Apparatus 10 also comprises a coin switch 60 and a lever 62, shown in FIG. 1. The coin switch 60 acts as the actuator in the embodiment of FIG. 1. A combination of the components to be described can also be thought of as an actuator, since they assist the coin switch 60 in the actuation of the apparatus 10. The coin switch 60 is actuated by a coin falling on the lever 62, however, alternatively the coin switch 60 could be actuated by a credit card. A slot would be placed at the top of the apparatus 10 for insertion of the credit card and the switch 60 would be centered so that lever 62 could be actuated by an edge of the credit card, and the switch 60 would be located so that the center of an edge of the credit card would press down on the lever 62 to actuate the apparatus 10.

Figure 2:
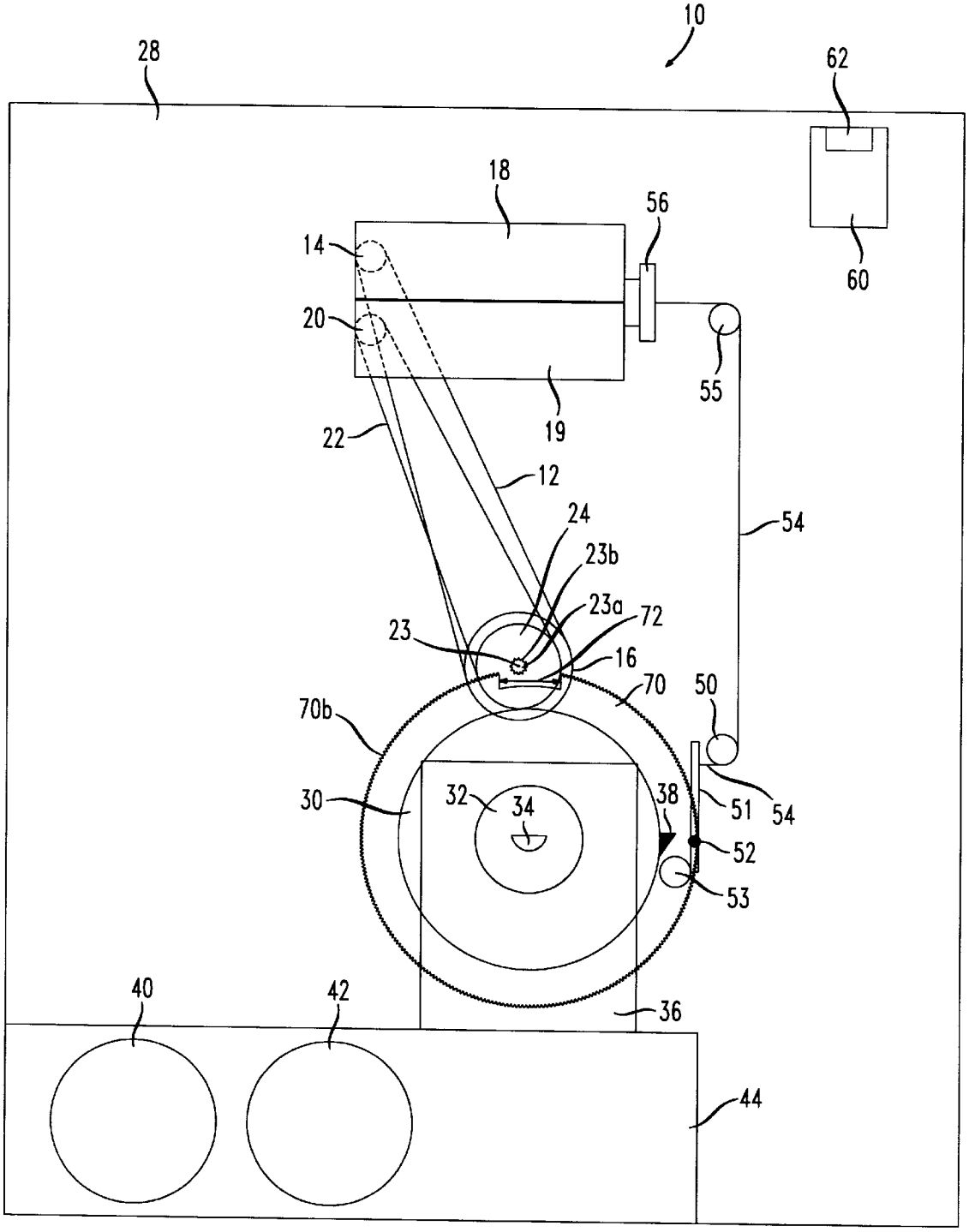
FIG. 2 shows a front view of a second layer on top of the first layer of the first embodiment.

FIG. 2 concerns the counter gear 70. FIG. 2 is a front view of a second layer of components of apparatus 10 on top of the first layer of components of apparatus 10. FIG. 2 shows the same components as FIG. 1 along with additional components. FIG. 2 additionally shows counter gear 70 having a gap 72. counter gear 70 is mounted on axle 34 of motor 32 so that when the axle 34 rotates, counter gear 70 also rotates. Counter gear 70 preferably has fine teeth 70*b* which are compatible with the teeth 23*b* on the gear 23*a* on the axle 23. When the counter gear 70 rotates clockwise, and assuming that the teeth 70*b* are engaged with the teeth 23*b*, the axle 23 rotates counter clockwise, causing the large pulleys 16 and 24 to rotate counter clockwise.

Figure 3:
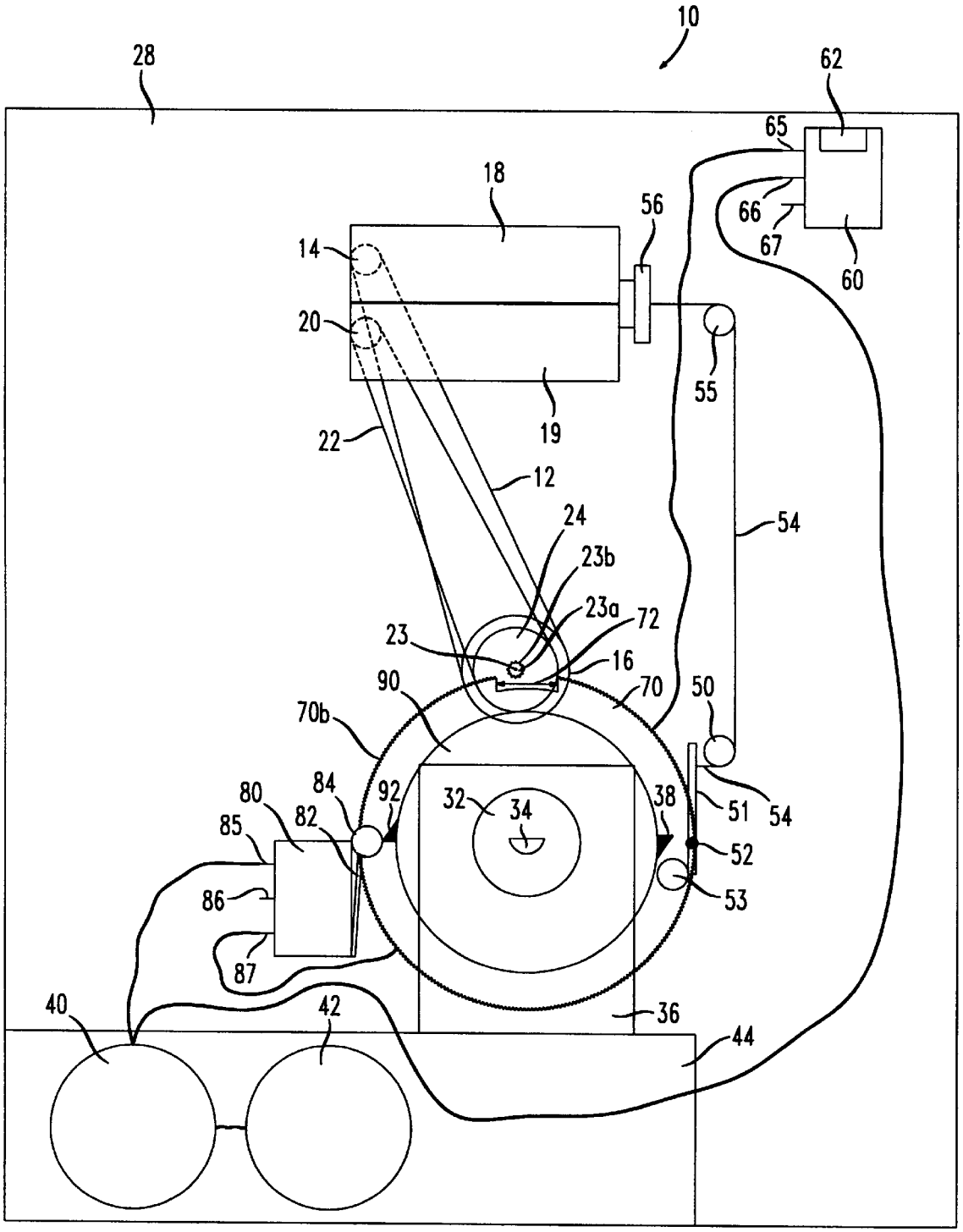
FIG. 3 shows a front view of a third layer on top of the first and second layers of the first embodiment.
Figure 5:
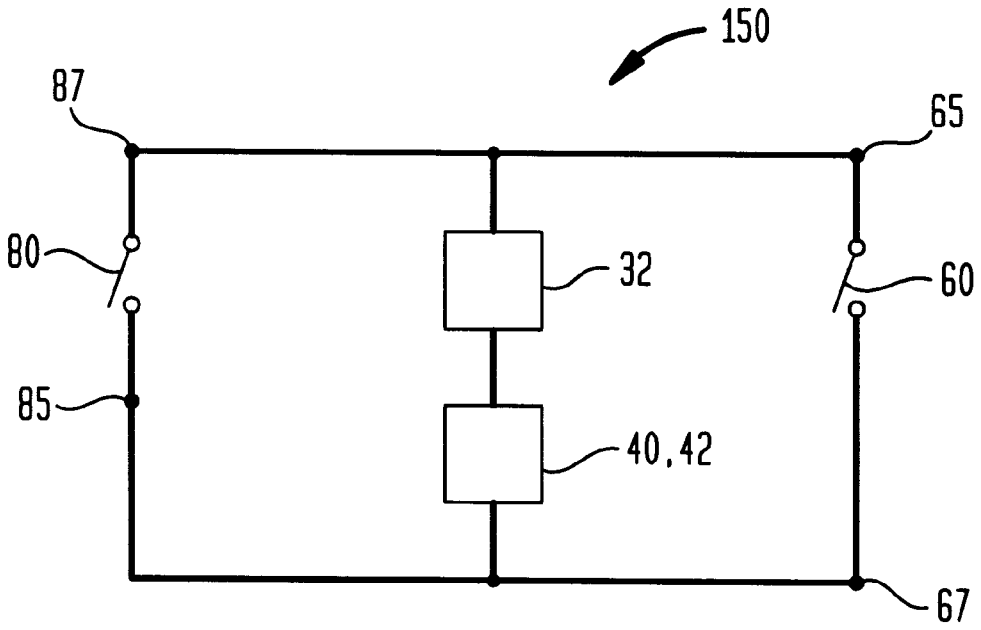
FIG. 5 shows a circuit diagram in accordance with the first embodiment of the present invention.

FIG. 3 concerns roller switch 80 and roller switch wheel 90. FIG. 3 is a front view of a third layer of components of apparatus 10 on top of the first layer shown in FIG. 1 and on top of the second layer of components shown in FIG. 2 of apparatus 10. FIG. 3 shows the same components as FIGS. 1 and 2 along with additional components. FIG. 3 additionally shows a roller switch 80 which includes a lever 82 and a roller 84. The roller switch 80 includes three terminals 85, 86, and 87. Terminal 85 is connected to the battery 40 which is connected in series to the other battery 42. A basic circuit diagram is shown in FIG. 5. Terminal 87 is connected to one terminal of the motor 32. The terminal 86 is not connected to anything. By using terminals 85 and 87, the switch 80 is operational when the lever 82 is in a state of release, and the switch 80 is not operational when the lever 82 is in a state of compression. Terminal 65 of coin switch 60 is connected to a terminal of motor 32, as shown in the circuit diagram of FIG. 5, and terminal 66 of coin switch 60 is connected to a terminal of battery 40. The coin switch 60 is operational when compressed, i.e. when a coin presses down on lever 62, and not operational when released. The motor 32 is connected in series with the batteries 40 and 42 as shown in FIG. 5, connection not shown in FIG. 3.

FIG. 3 also shows a roller switch wheel 90 having a protrusion 92. The roller switch wheel 90 is mounted on the axle 34 of the motor 32, and the roller switch wheel 90 rotates when the axle 34 rotates.

Figure 4:
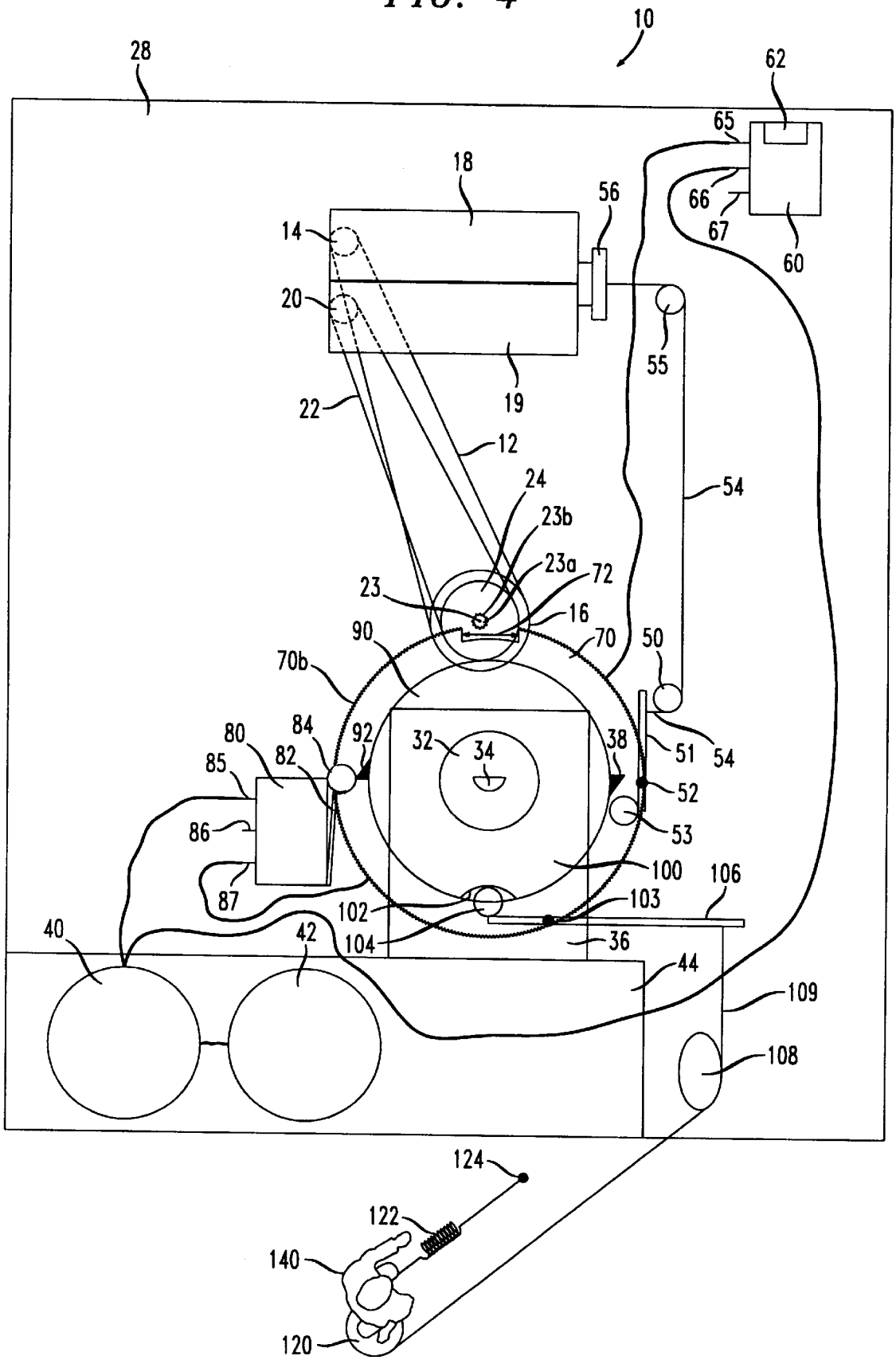
FIG. 4 shows a front view of a fourth layer of top of the first, second and third layers of the first embodiment.

FIG. 4 concerns model wheel 100. FIG. 4 is a front view of a fourth layer of components of apparatus 10 on top of the first layer shown in FIG. 1, the second layer of components shown in FIG. 2, and the third layer of components shown in FIG. 3, of apparatus 10. FIG. 4 shows the same components as FIGS. 1, 2, and 3 along with additional components. FIG. 4 additionally shows model wheel 100 which has an indentation 102. Also shown is a lever 106 with a roller 104 at the end. The lever 106 pivots about the fixed pivot point 103. A string 109 is connected to an end of the lever 106. The string 109 goes around the pulley 108 and then out to pulley 120, around pulley 120, and is then connected to spring 122. Spring 122 is connected to fixed point 124. A model 140 is placed on top of pulley 120. The model 140 is shown in reduced form for convenience, the model 140 is preferably as large as the apparatus 10.

FIG. 5 shows a basic circuit diagram 150 for the apparatus 10. The diagram 150 shows roller switch 80 connected in parallel with motor 32 and batteries 40 and 42. Coin switch 60 is also connected in parallel with motor 32 and batteries 40 and 42. In this manner, either roller switch 80 or coin switch 60 can activate the motor 32. Preferably coin switch 60 initially activates the motor 32, then roller switch 80 takes over after the coin switch 60 disconnects, or is no longer operational.

FIG. 6 shows a side view of apparatus 10, with selected components, previously described.

Figure 7:
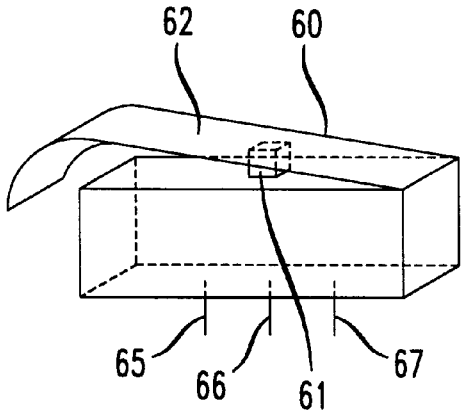
FIG. 7 is a close up view of a coin switch.
Figure 8:
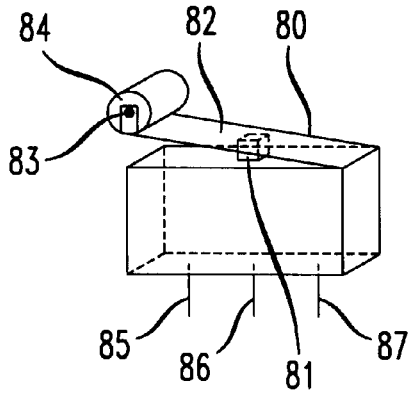
FIG. 8 is a close up view of a roller switch.

FIGS. 7 and 8 show enlarged views of coin switch 60 and roller switch 80 respectively. Coin switch 60 includes button 61, lever 62, and terminals 65, 66, and 67. Roller switch 80 includes button 81, lever 82, protrusion and axle 83 upon which roller 84 rotates, and terminals 85, 86, and 87.

During a rest state the model 140 is stationary in a first position and the counters 18 and 19 are not counting.

Referring to FIGS. 1–4, a user drops a coin onto lever 62 of coin switch 60. The coin switch 60, in conjunction with other components acts as an actuator in this embodiment. Referring to FIG. 7 the coin pushes the lever 62 downwards causing the button 61 to be pushed downwards, resulting in the activation of the coin switch 60. The activation of the switch 60 closes the circuit shown in FIG. 5, causing the motor 32 to be connected in a closed circuit with the batteries 40 and 42. The coin switch 60 is disconnected when a coin no longer pushes on lever 62. The motor 32 is activated by the activation of switch 60, and the axle 34, shown in FIGS. 1–4, and 6 begins to turn clockwise. The axle 34 turns reset wheel 30, counter gear 70, roller switch wheel 90 and model wheel 100.

The reset wheel 30 is used to reset the counters 18 and 19 during the first transition state. The operation of the reset wheel 30 is as follows. After a coin activates coin switch 60, the reset wheel 30 turns and the protrusion 38 pushes roller 53 and lever 51. When the roller 53 end of the lever 51 is pushed, the other end of the lever 51 moves in the opposite direction, because of the pivotting of lever 51 about the pivot point 52. The non-roller end of the lever 51 is connected to the string 54. When the roller 53 end of the lever 51 is pushed, the other end of lever 51 pulls the string 54 which pulls the reset mechanism 56 and thereby resets the counters 18 and 19. When the wheel 30 rotates further, the roller 53 and lever 51 go back into normal position so that the reset mechanism 56 is no longer being pulled, the counters 18 and 19 are no longer being reset, and are capable of being incremented.

Counter gear 70 is used during the operation state to increment the counters 18 and 19 so that for at least part of the first transition state, which includes at least part of a time period during which the model 140 is moving from the first position to a second position, the counters 18 and 19 are not counting. During operation, after the roller 53 and lever 51 go back into their rest position, the gear 70 reaches the end of gap 72, after the gear 70 has rotated clockwise a sufficient distance. The teeth 23*b* on the gear 23*a* on the axle 23 begin to interact with the teeth 70*b* of the gear 70, causing the axle 23 to turn. The teeth 23*b* and the teeth 70*b* should be compatible. When the axle 23 turns, the pulleys 24 and 16 also turn, thereby turning belts 22 and 12 respectively. The belts 22 and 12 turn the pulleys 20 and 14 respectively, which turns the axles 21 and 15 respectively of the counters 19 and 18. The axles 21 and 15 increment the counters 19 and 18 respectively. Counter 19 is for gallons and fractions of gallons. Counter 18 is for dollars and cents. After the gear 70 has rotated approximately one complete revolution, the gear 70 stops when the motor 32 is deactivated by switch 80 being disconnected. When the counter gear 70 stops rotating, the counters 18 and 19 stop counting.

Roller switch wheel 90 is used to activate and deactivate the roller switch 80 which provides a sustaining electrical circuit with the motor 32 and the batteries 40 and 42. The roller switch wheel 90 in conjunction with the motor 32 and other components is used as a timing mechanism and provides the duration of time for the operation state, i.e. the duration for which the model 140 remains stationary in the second position and for which the counters 18 and 19 count. When the roller switch wheel 90 turns the roller 84 comes off of the protrusion 92. This causes the lever 82 to release which causes the actuation of the roller switch 80. The roller switch 80 takes over for the coin switch 60, in the sense that the roller switch 80 provides an electrical connection, as shown in FIG. 5, so that the motor 32 is activated by the batteries 40 and 42. The motor 32 remains activated by the switch 80 for approximately a single revolution of the roller switch wheel 90. When the roller switch wheel 90 has completed its revolution, the protrusion 92 causes compression of the lever 82 which disconnects the switch 80 and causes the motor 32 to turn off and stops the axle 34 and the roller switch wheel 90 from rotating. The motor 32, counter gear 70, roller switch wheel 90, and model wheel 100 together act as a termination device in this embodiment, moving model 140 back to its first position and stopping the counters 18 and 19 from counting during a second transition state.

Model wheel 100 controls the turning of the model 140. At rest, as shown in FIG. 4, the roller 104 is in the indentation 102 of the model wheel 100. During the first transition state, the rotation of the axle 34 and thus the model wheel 100 causes the roller 104 to be forced out of the indentation 102. This causes the lever 106 to pivot about the pivot point 103. The non-roller end of the lever 106 is forced upwards and thus pulls on the string 109. This pulling causes the pulley 120 to turn and the spring 122 to be pulled or expanded. The model 140 on top of the pulley 120 turns when the pulley 120 turns. The time during which the model 140 moves from a first position at rest to a second position during operation will be called a first transition state. During an operation state, which is while the counters 18 and 19 are active and incrementing, the model 140 is stationary in its second position.

When the model wheel 100 has made approximately one revolution, the roller 104 falls back into the indentation 102 of the model wheel 100. This causes the non-roller end of the lever 106 to fall back down, which causes the release of tension in the string 109, which causes the pulley 120 to turn, and the spring 122 to no longer be pulled. When the pulley 120 turns, the model on the pulley 120 goes back to its first position or rest position. The time during which the model moves from the second position or operational position to the rest position or first position, is called the second transition state.

Figure 9:
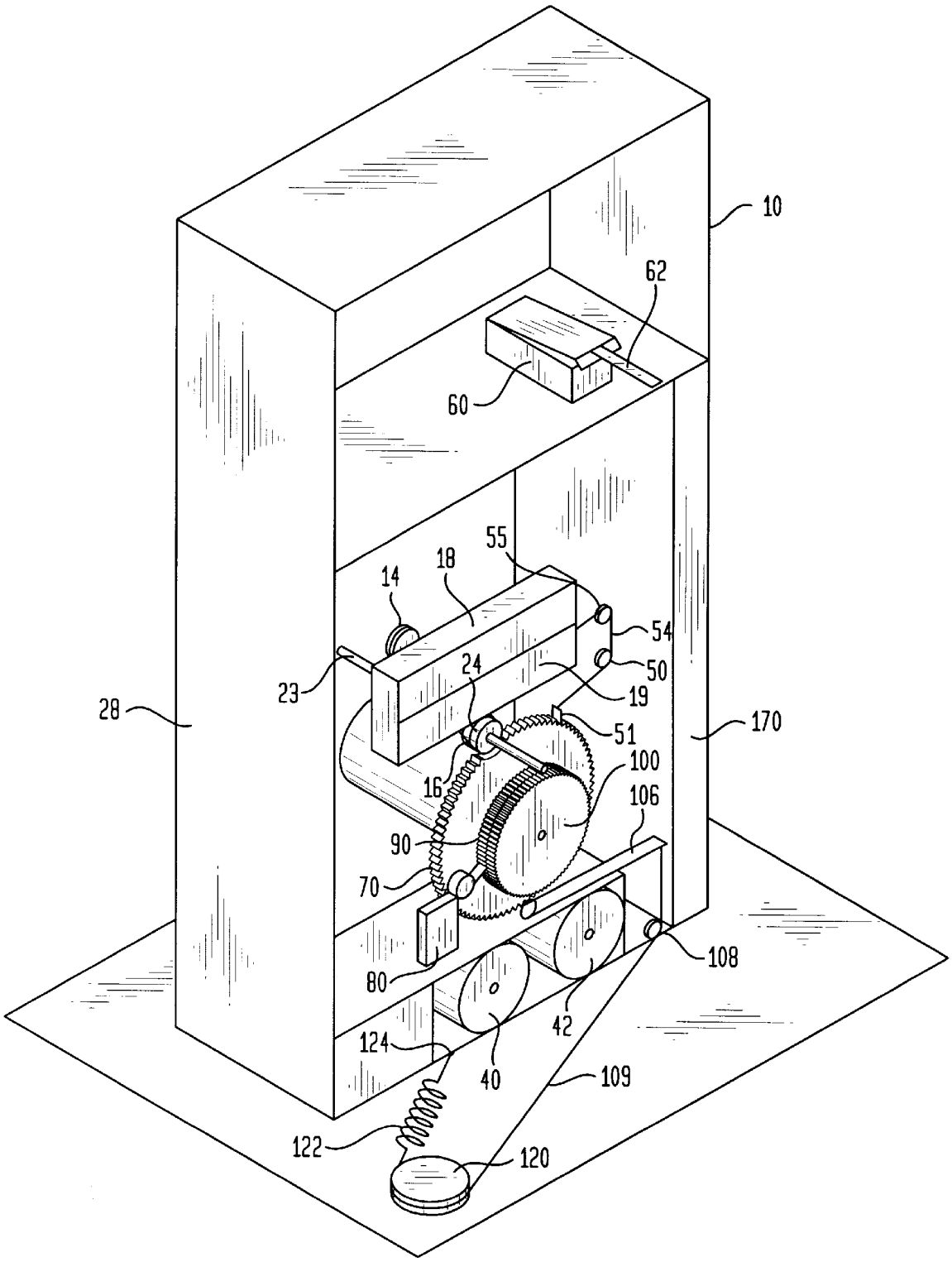
FIG. 9 is a perspective uncovered view of an apparatus in accordance with the first embodiment with selected components and with a coin actuation switch.
Figure 11:
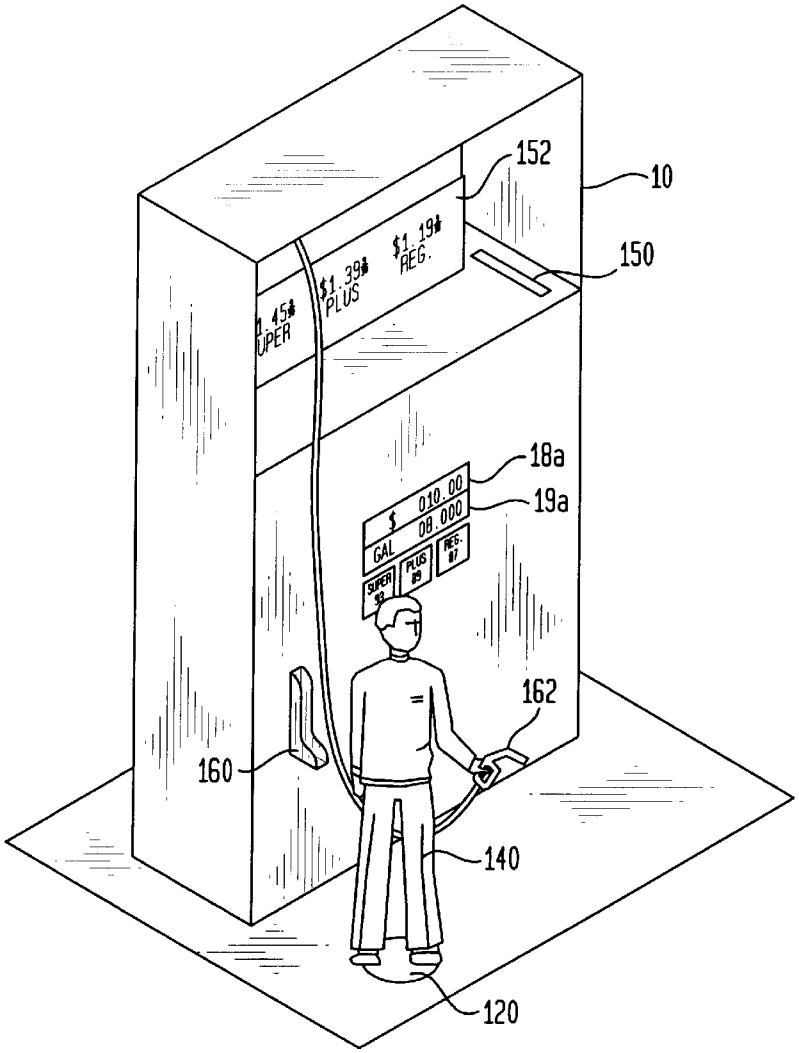
FIG. 11 is a perspective covered view of an apparatus in accordance with the first embodiment with a coin actuation switch, with a model turned to pump, and with selected components.

FIG. 9 is a perspective uncovered view of the first embodiment, apparatus 10, with selected components and with a coin actuation switch 60. FIG. 11 shows the location of coin slot 150 for inserting a coin which would fall on lever 62 to operate coin switch 60. The coin after being dropped on lever 62 then falls into coin bank 170.

Figure 10:
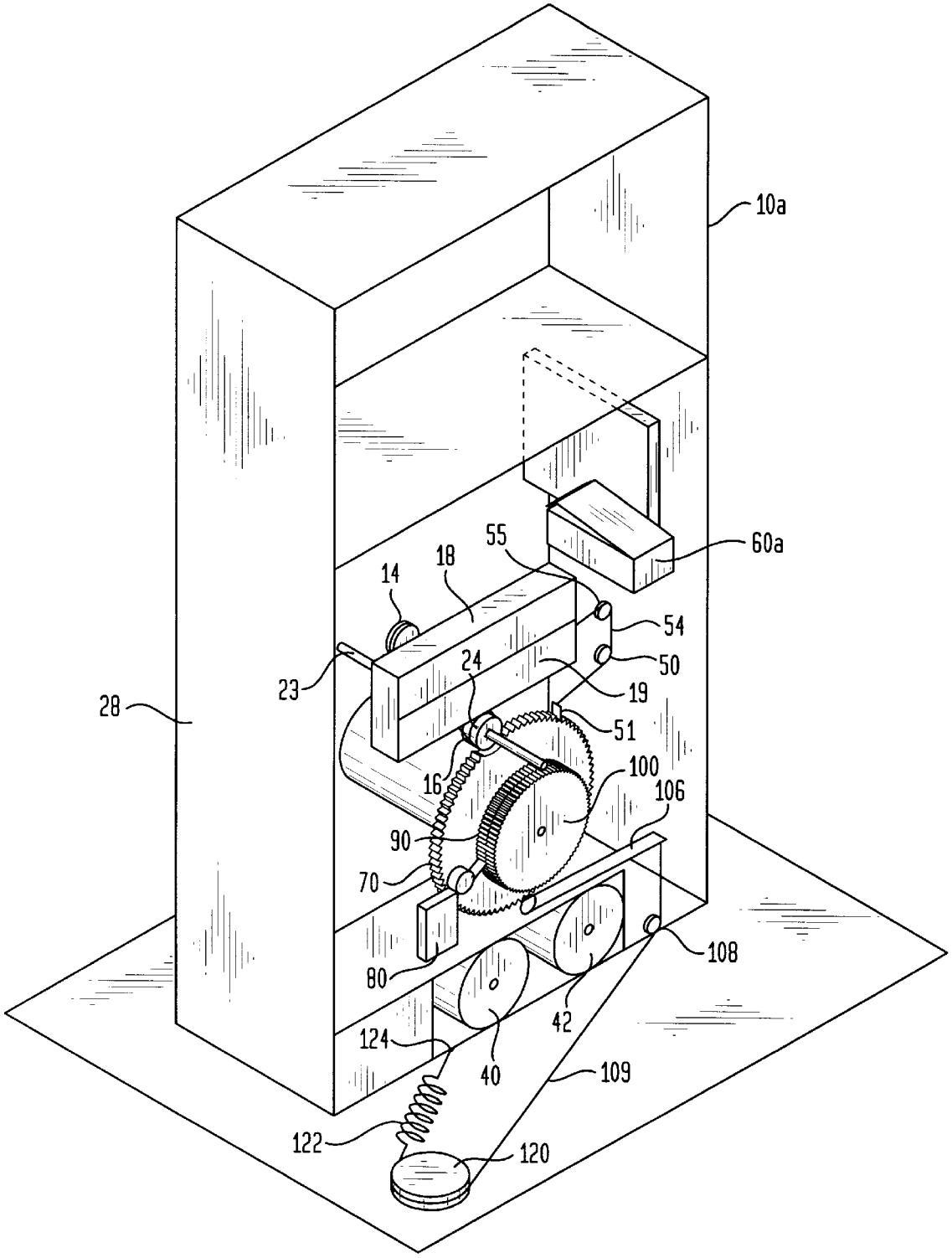
FIG. 10 is a perspective uncovered view of an apparatus in accordance with the first embodiment with selected components and with a credit card actuation switch.
Figure 12:
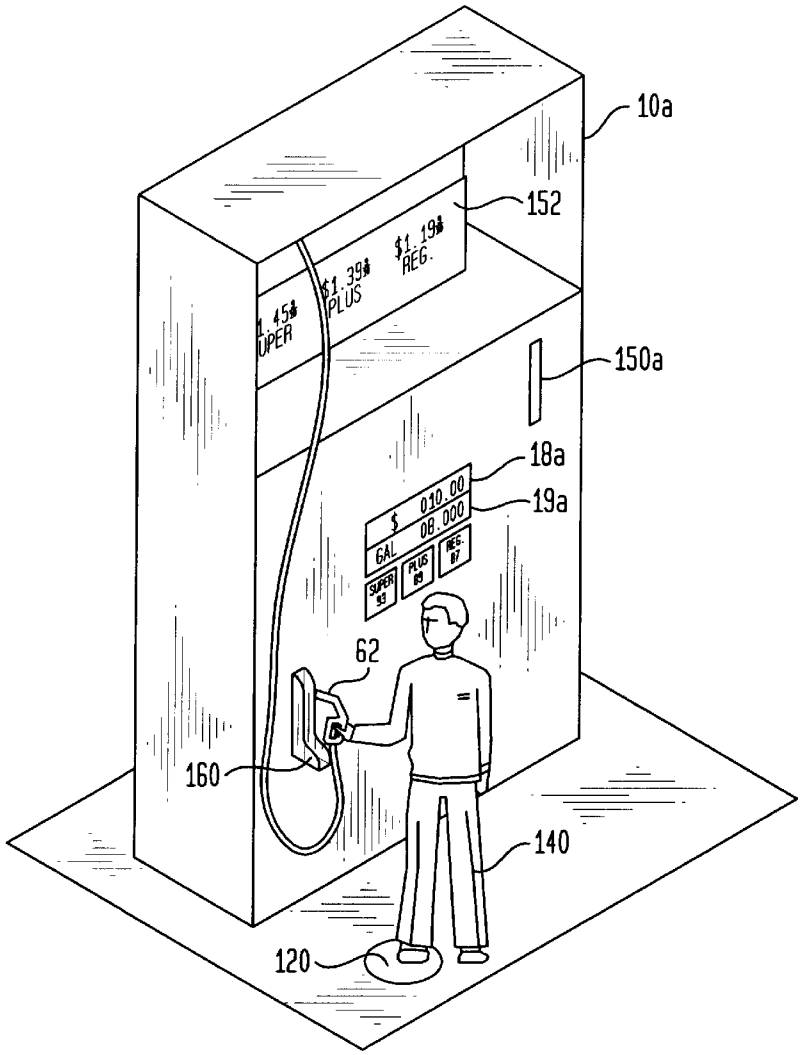
FIG. 12 is a perspective covered view of an apparatus in accordance with the first embodiment with a credit card actuation switch, with a model turned to place a nozzle back, and with selected components.

FIG. 10 is a perspective uncovered view of portions of an apparatus 10*a,* exactly the same as FIG. 9, but with a credit card actuation switch 60*a* instead of a coin switch 60. FIG. 12 shows the location of credit card slot 150*a* for inserting a credit card to actuate the credit card switch 60*a*. Switch 60*a* would then function preferably similar to coin switch 60.

FIG. 11 is a perspective covered view of the first embodiment apparatus 10, with a coin actuation switch 60, with a model 140 turned to pump, and with selected components. The model 140 holds the handle 162. The model 140 is preferably in the position shown in FIG. 11, during the operational state, i.e. after a coin has been inserted into slot 150 and during operation of the device. FIG. 11 shows a sign indicating prices for gas at 152. FIG. 11 also shows the output 18*a* and 19*a* of the counters 18 and 19, respectively.

FIG. 12 is a perspective covered view of apparatus 10*a*. FIG. 12 differs from FIG. 11 in that a credit card actuation slot 150*a* is shown and in that the model 140 is shown in its rest position. The handle 162 is shown placed in the holder 160 of the apparatus 10*a*.

Figure 13:
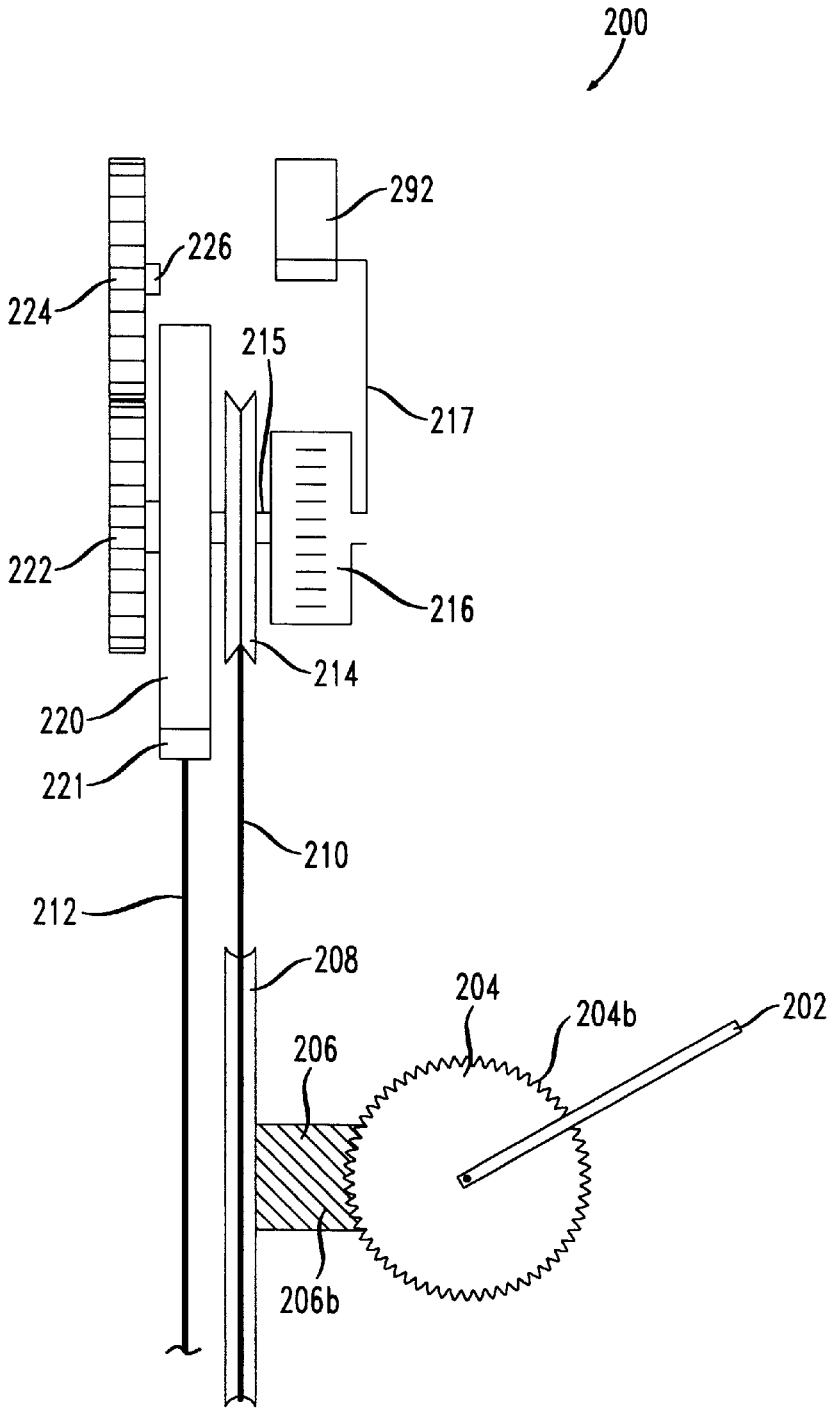
FIG. 13 is a side view of some of the components of a second embodiment of the present invention.

FIG. 13 shows some components of an apparatus 200 in accordance with a second embodiment of the present invention. Apparatus 200 includes lever 202 which is connected to reel 204. Reel 204 may be a fishing reel. Reel 204 includes teeth 204*b*.

The teeth 204*b* interact with the teeth 206*b* of gear 206. Preferably, the teeth 204*b* are actually located behind reel 204, so that when reel 204 rotates clockwise, looking at the FIG. 13 view, the gear 206 rotates counterclockwise, looking at the back of apparatus 200 in FIG. 16. This in turn causes the pulley 208 to rotate clockwise, looking at the front view of FIG. 17. Pulley 208 has a string 210 connected to it. String 210 is also connected to pulley 214. Pulley 214 is mounted to an axle 215. Axle 215 is connected to a music box 216.

Apparatus 200 also includes model wheel 220, dial counter first gear 222 and dial counter second gear 224. Model wheel 220 and dial counter first gear 222 are mounted to the axle 215 so that when the axle 215 rotates, the model wheel 220 and the dial counter first gear 222 rotate. Dial counter second gear 224 is rotatably mounted to an axle 226.

The dial counter second gear 224 can rotate about the axle 226. During the time, which is the operation state, that the music box 216 is playing the axle 215 rotates causing the model wheel 220 to rotate which causes the dial counter first gear 222 to turn counter clockwise, when looking at the front of the apparatus 200 as in FIG. 17. The dial counter first gear 222 has teeth which interact with the dial counter second gear 224 so that rotation of the dial counter first gear 222 counter clockwise causes the dial counter second gear 224 to rotate clockwise. A dial 301 shown in FIG. 14 which is attached to the dial counter second gear 224 rotates with the dial counter second gear 224 to simulate the operation of a dial gas pump. Also refer to below discussion concerning FIG. 17 for these components.

Figure 17:
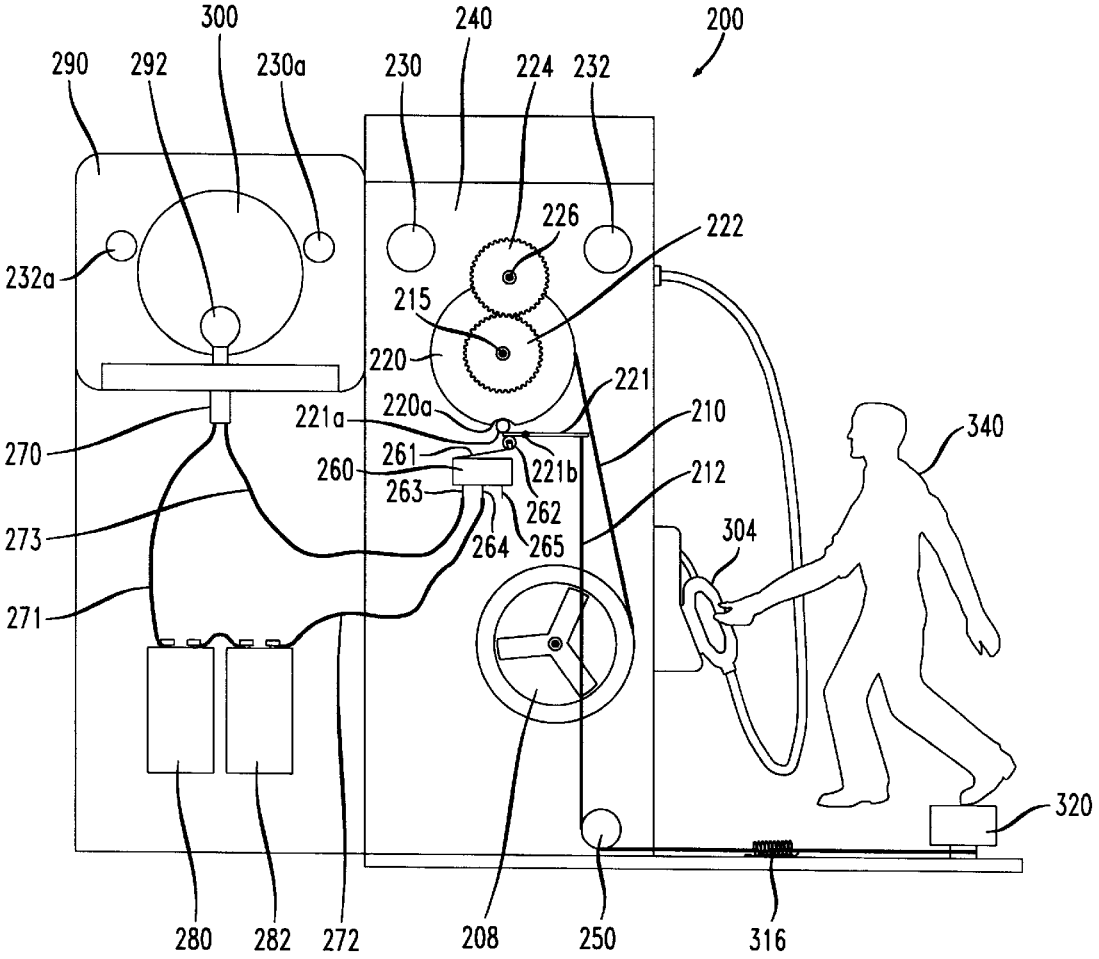
FIG. 17 shows a front view of the second embodiment where the door of the device is open.

FIG. 17 shows a front view of the apparatus 200 with a door 290 open so that various internal components can be seen. Components of apparatus 200 shown in FIG. 17 include pulley 208, string 210, model wheel 220, dial counter first gear 222 and dial counter second gear 224.

Figure 18:
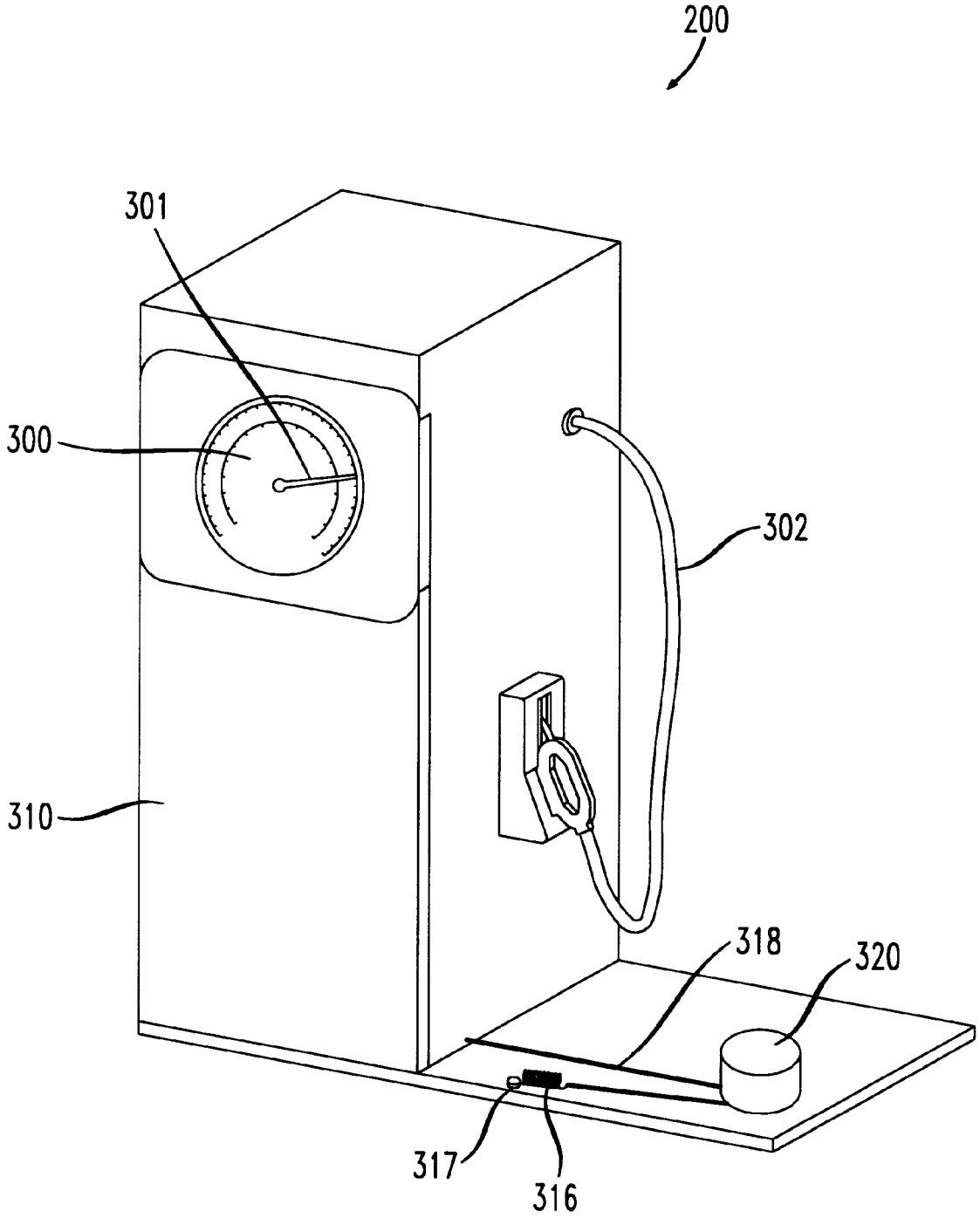
FIG. 18 is a perspective view of the second embodiment in an assembled form.

Dial cover 300 is shown in FIG. 17. String 212 is shown Winding around the pulley 250, then winding around the pulley 320 and then connected to the spring 316 which is connected to a fixed point 317, shown in FIG. 18.

Also shown in FIG. 17 is light switch 260 which includes lever 261 and roller 262. The light switch 260 is mounted to the housing 240. Terminals 263, 264, and 265 of the light switch 260 are also shown. A light socket 270 and light bulb 292 are shown. The terminal 263 of light switch 260 is connected by wire 273 to a first terminal of light socket 270. The terminal 264 of switch 260 is connected by wire 272 to a terminal of battery 282. The batteries 280 and 282 are connected in series. The battery 280 has one of its terminals connected by wire 271 to a second terminal of light socket 270. The light 292, batteries 280 and 282, and the light switch 260 are thus connected in series in a completed circuit when the light switch 260 is operational. The light switch 260 is operated by pressing down on the lever 261.

Also shown in FIG. 17 are magnets 230 and 232 and corresponding metal connectors 230*a* and 232*a*. When the door 290 is closed, the magnets 230 and 232 adhere to the metal connectors 230*a* and 232*a*. The magnets 230 and 232 thus prevent the door 290 from easily opening.

A lever 221 is shown in FIG. 17, which has a roller 221*a* at one end of it, and which pivots about a pivot point 221*b*. The lever 221 is connected at its non roller end to a string 212 which is connected to string 318 which winds around pulley 320, is then connected to spring 316, which is connected to a fixed point 317, shown in FIG. 18. A model 340 shown in FIG. 17, is placed on top of the pulley 320 and will be turned during the operation of the apparatus 200. The model 340 preferably is facing the side of apparatus 200, such as in FIG. 15, during a rest state. The roller 221*a* fits into an indentation 220*a* of the model wheel 220, and when it does, it stops the music box 216 from playing and results in the model turning back so that it goes back to its rest state.

A light 292 turns on when the lever 221 presses down on a switch 260 shown in FIG. 17. This occurs during the playing of the music box 216. When the music box stops playing, the light 292 shuts off because the roller 221*a* of the lever 221 stops pressing on the switch 260 and the roller 221*a* fits back into the indentation 220*a* of the model wheel 220.

Figure 14:
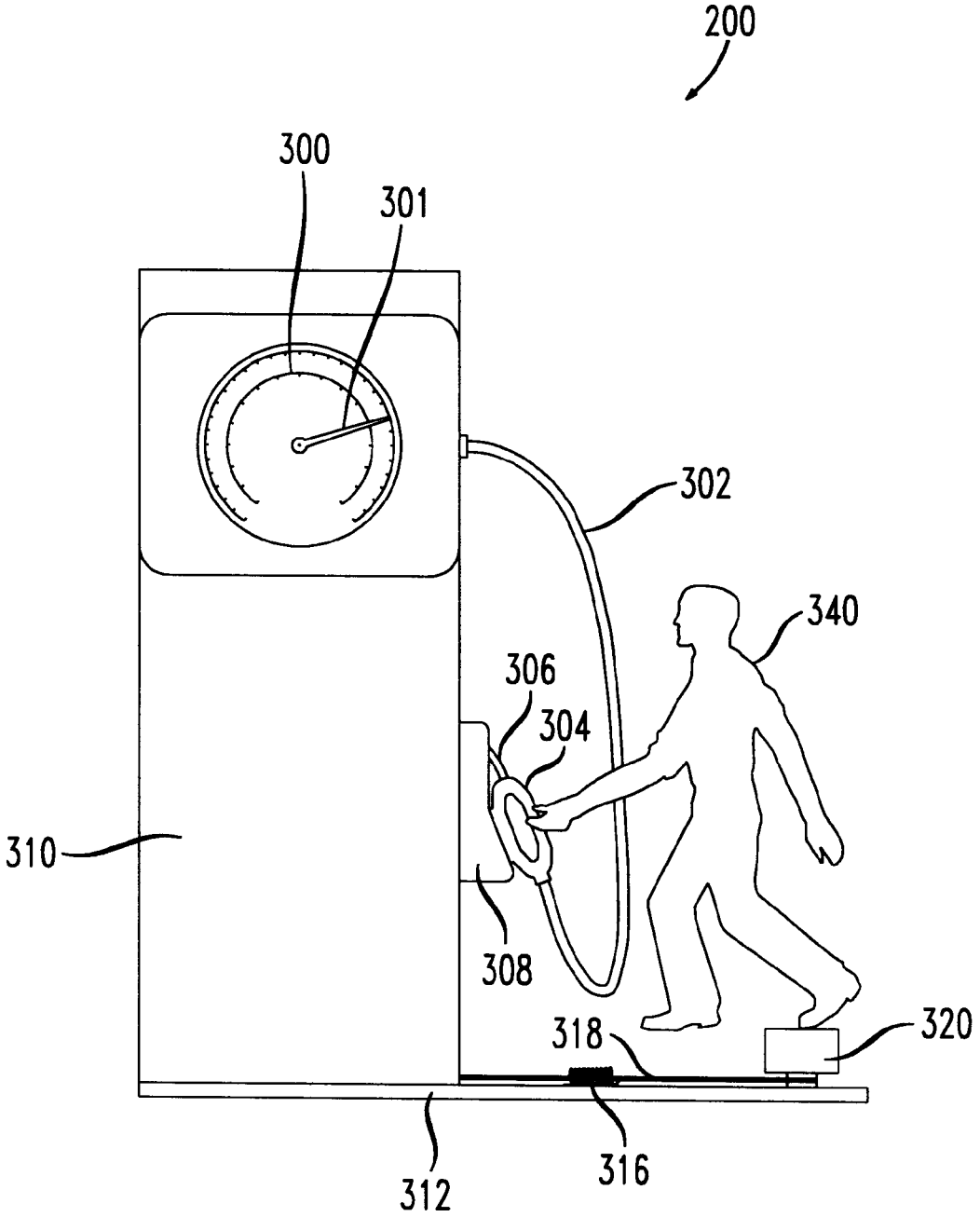
FIG. 14 is a front view of an assembled apparatus of the second embodiments.

FIG. 14 shows a front view of the assembled apparatus 200. Shown in FIG. 14 is a dial cover 300 which is preferably clear. A dial pin 301 is shown within the dial cover 300. A hose 302, handle 304 and nozzle 306 for simulating pumping gas are also shown in FIG. 14. A holder 308 for holding the nozzle 306 when gas is not being pumped (since this is preferably a toy, real gas would preferably not be pumped) is also shown in FIG. 14. The cover 310 of the apparatus 200 is also shown. Platform 312 is shown for mounting the cover 310 of the apparatus 200. Spring 316, String 318, and pulley 320 are also shown in FIG. 14.

Figure 15:
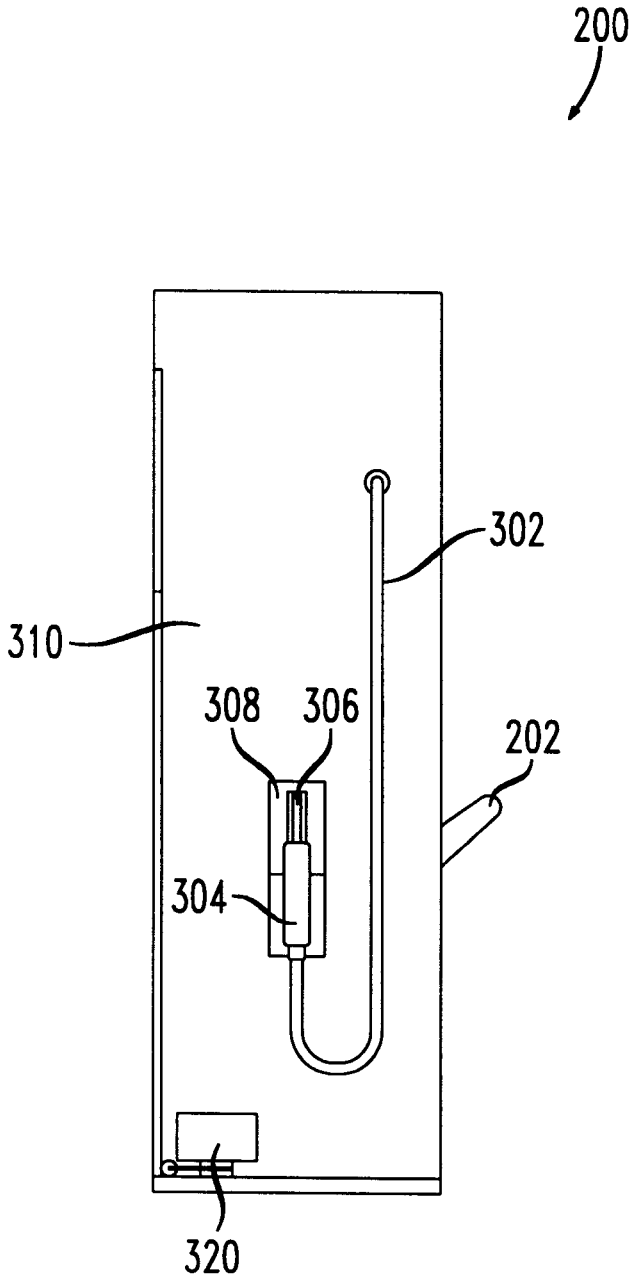
FIG. 15 is a side view of an assembled apparatus of the second embodiment.
Figure 16:
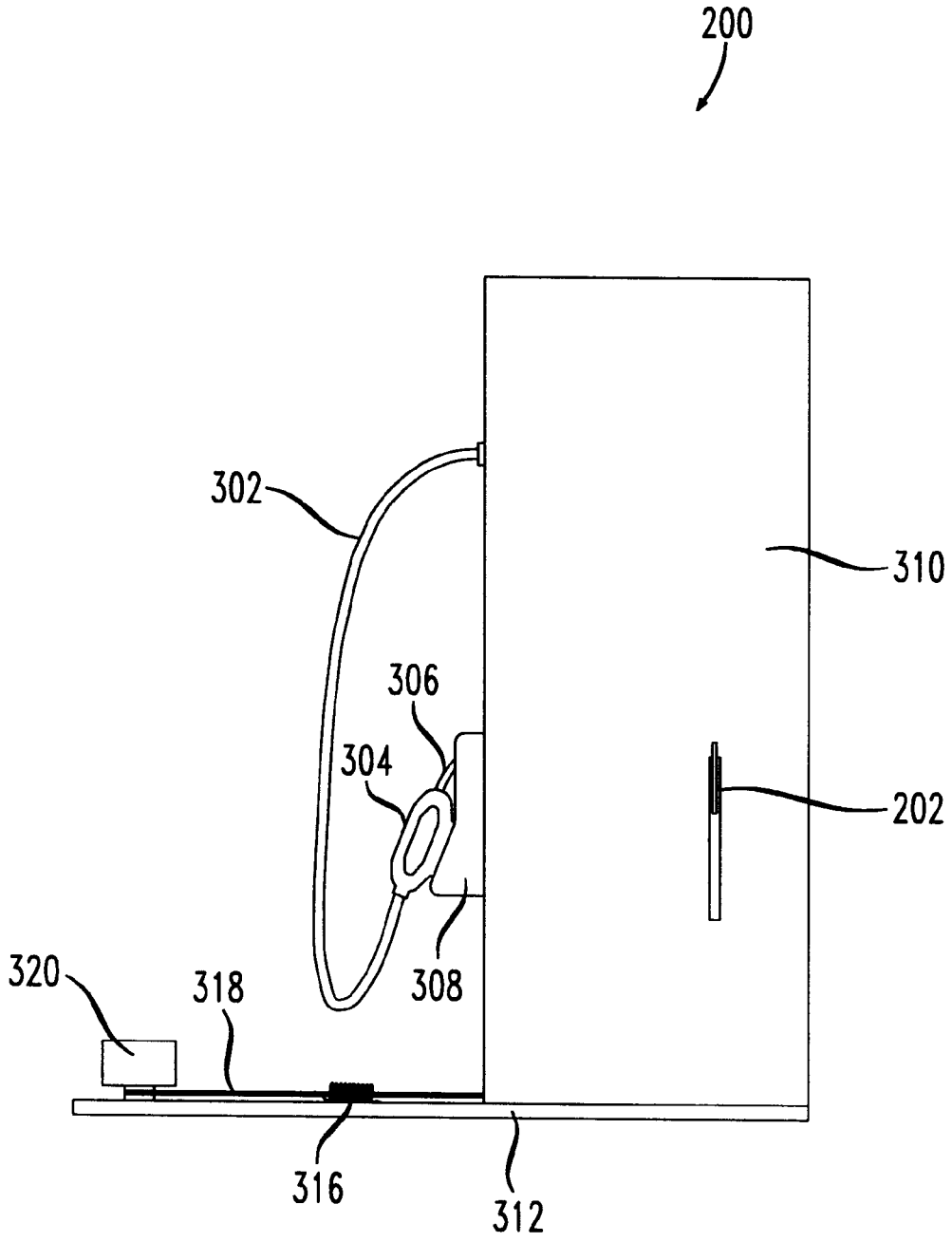
FIG. 16 is a back view of an assembled apparatus of the second embodiment.

FIG. 15 shows a side view of the apparatus 200 which includes covering 310, hose 302, lever 202, pulley 320, handle 304, nozzle 306, and holder 308. FIG. 16 shows a back view of the apparatus 200. With components previously described.

In operation, an individual pushes down on the lever 202, shown in FIG. 13, which causes the reel 204 to turn. The reel 204 has teeth 204*b* which interact with teeth 206*b* of the gear 206. The reel 204 and gear 206 interact such that, by turning the reel 204 a little, the gear 206 turns a lot. I.e. for example, for one revolution of the reel 204, the gear 206 preferably makes many complete revolutions. The reel 204 turns clockwise, viewed from FIG. 13, turning the gear 206 counter clockwise, as viewed from the back of the apparatus 200 such as FIG. 16. The gear 206 turns the pulley 208 clockwise, when viewed from the front of the device as in FIG. 17, which moves the string 210. The string 210 turns the pulley 214, clockwise, as viewed from the front. The pulley 214 turns the axle 215. The axle 215 by turning, winds up the music box 216. The axle 215, also by turning turns the model wheel 220 clockwise. Model wheel 220 by turning dislodges the roller 221*a* of the lever 221, causing lever 221 to pivot about pivot point 221*b*, and the non roller end of the lever 221 to pull up on the string 212 which winds around the pulley 250, as shown in FIG. 17. The string 212 pulls on the string 318 which winds around the pulley 320 and thus turns the pulley 320, as shown by FIGS. 13 and 14. The string 318 also pulls the spring 316 which is connected to a the fixed point 317. When the pulley 320 turns, the model 340 on the pulley 320 turns from a first position or rest position, facing the side of apparatus 200, i.e. towards the view shown in FIG. 15, to a second position or operation position, facing outward from FIG. 14. This turning operation is a first transition state. The model 340 keeps looking outward during an operation state of the apparatus 200.

The downward movement of the roller 221*a* of the lever 221 pushes down on the roller 262 of the lever 261 of the switch 260 causing the light switch 260 to be activated. This causes the light 292 to be turned on. The light 292 stays on while the roller end 221*a* is pushing down on the roller 262, which is during the operation state.

The movement of the axle 215 clockwise during the first transition state turns the dial counter first gear 222, causing the dial counter second gear 224 to turn and thus causing the pin 301, shown in FIG. 14 to turn. The pin 301 turns counterclockwise when the lever 202 of the reel 204 shown in FIG. 13 is pushed. This resets the pin 301 to a zero position.

After the lever 202 is released the axle 215, pulley 214, model wheel 220, and counter dial first gear 222 begin to slowly turn back counter clockwise at the speed dictated by the axle 215 of the windup music box 216. The counter dial second gear 224 turns in the opposite direction, i.e. a clockwise direction, and turns pin 301, in order to show incrementing of the amount of gas or the price. When the model wheel 220 has turned counter clockwise back to its original rest position, the roller 221*a* on the lever 221 fits back into the indentation 220*a* of the wheel 220. This stops the movement of the axle 215, pulley 214, model wheel 220, and the first dial gear 222 and the second dial gear 224. When the roller 221*a* on the lever 221 fits back into the indentation 220*a* of wheel 220 it also causes the non roller end of the lever 221 release or go down which causes the string 212 to release, the pulley 250 to turn, the string 318 to release, the pulley 320 to turn back to its original position, and the spring 316 to release. This is the second transitional state when the model 340 goes back from the second position during operation to its original first position.

I claim:

1. An apparatus comprising:

a model;

a first counter;

an actuator;

a termination device;

a model movement device;

wherein during a rest state the model is stationary in a first position and the first counter is not counting;

during a first transition state the model movement device moves the model from its first position to a second position in response to actuation of the actuator and the first counter begins counting;

during an operation state the model is stationary in a second position and the first counter is counting at a first rate;

during a second transition state, in response to the termination device the model is moved by the model movement device from its second position back to its first position and the first counter stops counting; and wherein the first counter has an output which displays one or more numerals.

2. The apparatus of claim 1 and wherein:

actuation of the actuator causes the first counter to reset.

3. The apparatus of claim 1 wherein the first counter is part of a toy gas pump.

4. The apparatus of claim 1 and further comprised of:

a second counter, which starts counting during the first transition state, counts during the operation state, and stops counting during the second transition state; and wherein the second counter counts at a second rate.

5. The apparatus of claim 4 and wherein:

the first rate at which the first counter counts is different from the second rate at which the second counter counts.

6. The apparatus of claim 4 wherein the second counter has an output which displays one or more numerals.

7. The apparatus of claim 6 wherein the second counter is party of a toy gas pump.

8. The apparatus of claim 1 and further comprised of:

a timing mechanism for controlling the duration of time of the operation state.

9. The apparatus of claim 8 and further wherein:

the timing mechanism and the first counter are controlled by a single control means.

10. The apparatus of claim 9 and wherein the single control means is comprised of a motor.

11. The apparatus of claim 8 and further wherein:

the timing mechanism and the model movement device are controlled by a single control means.

12. The apparatus of claim 11 and wherein the single control means is comprised of a motor.

13. The apparatus of claim 8 and further wherein:

the model movement device and the first counter are controlled by a single control means.

14. The apparatus of claim 13 and wherein the single control means is comprised of a motor.

15. An apparatus comprising:

a model;

a first counter;

an actuator;

a termination device;

a model movement device;

wherein during a rest state the model is stationary in a first position and the first counter is not counting;

during a first transition state the model movement device moves the model from its first position to a second position in response to actuation of the actuator and the first counter begins counting;

during an operation state the model is stationary in a second position and the first counter is counting at a first rate;

during a second transition state, in response to the termination device the model is moved by the model movement device from its second position back to its first position and the first counter stops counting;

actuation of the actuator causes the first counter to reset.

16. The apparatus of claim 15 and further comprised of:

a second counter, which starts counting during the first transition state, counts during the operation state, and stops counting during the second transition state, and wherein the second counter counts at a second rate.

17. The apparatus of claim 16 and wherein:

the first rate at which the first counter counts is different from the second rate at which the second counter counts.

18. An apparatus comprising:

a model;

a first counter;

an actuator;

a termination device;

a model movement device;

wherein during a rest state the model is stationary in a first position and the first counter is not counting;

during a first transition state the model movement device moves the model from its first position to a second position in response to actuation of the actuator and the first counter begins counting;

during an operation state the model is stationary in a second position and the first counter is counting at a first rate;

during a second transition state, in response to the termination device the model is moved by the model movement device from its second position back to its first position and the first counter stops counting; and and further comprised of a timing mechanism for controlling the duration of time of the operation state.

19. The apparatus of claim 18 and further wherein:

the timing mechanism and the first counter are controlled by a single control means.

20. The apparatus of claim 19 and wherein the single control means is comprised of a motor.

21. The apparatus of claim 18 and further wherein:

the timing mechanism and the model movement device are controlled by a single control means.

22. The apparatus of claim 21 and wherein the single control means is comprised of a motor.

23. The apparatus of claim 18 and further wherein:

the model movement device and the first counter are controlled by a single control means.

24. The apparatus of claim 23 and wherein the single control means is comprised of a motor.

25. An apparatus comprising:

a model;

a first counter;

an actuator;

a termination device;

a model movement device;

wherein during a rest state the model is stationary in a first position and the first counter is not counting;

during a first transition state the model movement device moves the model from its first position to a second position in response to actuation of the actuator and wherein for at least part of the first transition state, which includes at least part of a time period during which the model is moving from the first position to the second position, the counter is not counting; and during an operation state the model is stationary in a second position and the first counter is counting at a first rate.

26. The apparatus of claim 25 wherein the first counter has an output which displays one or more numerals.

27. The apparatus of claim 26 wherein during a second transition state, in response to the termination device the model is moved by the model movement device from its second position back to its first position and the counter stops counting.

28. The apparatus of claim 27 wherein the first counter has an output which displays one or more numerals.

* * * * *